US009166341B2

(12) United States Patent
Wang et al.

(10) Patent No.: US 9,166,341 B2
(45) Date of Patent: Oct. 20, 2015

(54) SYSTEM FOR PREVENTING MATING ERRORS BETWEEN ELECTRICAL CONNECTORS

(75) Inventors: Yingtao Wang, Guangdong (CN); Longfei Wang, Guangdong (CN)

(73) Assignee: HARTING ELECTRONICS GMBH, Espelkamp (DE)

( * ) Notice: Subject to any disclaimer, the term of this patent is extended or adjusted under 35 U.S.C. 154(b) by 50 days.

(21) Appl. No.: 14/117,699

(22) PCT Filed: May 17, 2011

(86) PCT No.: PCT/CN2011/074157

§ 371 (c)(1),
(2), (4) Date: Nov. 14, 2013

(87) PCT Pub. No.: WO2012/155338

PCT Pub. Date: Nov. 22, 2012

(65) Prior Publication Data

US 2014/0065891 A1 Mar. 6, 2014

(51) Int. Cl.
*H01R 13/645* (2006.01)
*H01R 13/641* (2006.01)

(52) U.S. Cl.
CPC ..... *H01R 13/6456* (2013.01); *H01R 13/641* (2013.01); *H01R 13/645* (2013.01); *H01R 13/6453* (2013.01)

(58) Field of Classification Search
CPC . H01R 13/645; H01R 13/6453; H01R 13/641
USPC ..... 439/681, 701, 677, 680, 695
See application file for complete search history.

(56) References Cited

U.S. PATENT DOCUMENTS

| | | | | | |
|---|---|---|---|---|---|
| 4,159,862 | A * | 7/1979 | Funck et al. | ..... | 439/681 |
| 5,254,019 | A * | 10/1993 | Noschese | ..... | 439/681 |
| 6,059,600 | A * | 5/2000 | Vanbesien | ..... | 439/378 |
| 6,632,107 | B1 * | 10/2003 | Vanbesien | ..... | 439/680 |
| 6,814,625 | B2 * | 11/2004 | Richmond et al. | ..... | 439/681 |
| 8,851,934 | B2 * | 10/2014 | McAlonis et al. | ..... | 439/680 |
| 8,911,263 | B2 * | 12/2014 | Becavin | ..... | 439/681 |
| 2011/0294361 | A1 * | 12/2011 | Schrader | ..... | 439/680 |
| 2013/0280950 | A1 * | 10/2013 | Becavin | ..... | 439/488 |

FOREIGN PATENT DOCUMENTS

| | | | |
|---|---|---|---|
| CN | 2540668 | Y | 3/2003 |
| CN | 201498775 | U | 6/2010 |
| EP | 1995829 | A1 | 11/2008 |
| GB | 832658 | | 4/1960 |

* cited by examiner

*Primary Examiner* — Amy Cohen Johnson
*Assistant Examiner* — Matthew T Dzierzynski
(74) *Attorney, Agent, or Firm* — Jacobson Holman, PLLC.

(57) ABSTRACT

A mounting frame is proposed for a system for preventing mating errors between electrical connectors, which mounting frame surrounds the connector at least on the plug side, wherein at least one coding element is held in the mounting frame. The coding element can rotate about its longitudinal axis and can be fixed in various radial positions in a front holding frame, wherein the front holding frame together with a rear securing frame forms the mounting frame. The coding element only interacts with a coding element on the mating connector to be connected when two connectors are being mated in a correspondingly correct position in the mounting frame, thus allowing the connectors to be mated.

8 Claims, 8 Drawing Sheets

SYSTEM FOR PREVENTING MATING ERRORS BETWEEN ELECTRICAL CONNECTORS

This is a national stage of PCT/CN11/074157 filed May 17, 2011 and published in English, hereby incorporated by reference.

BACKGROUND OF THE INVENTION

The invention relates to a system for preventing mating errors between electrical connectors which can be connected to one another in pairs, comprising a multi-part mounting frame which in each case surrounds one connector, at least on the plug side, comprising at least one coding element, which is arranged in the mounting frame and can be inserted into a coding opening in the mounting frame in a position which can be varied radially about its longitudinal axis, and wherein the coding element interacts with the coding element on a mating connector to be connected only in a correspondingly correct position in the mounting frame.

A system such as this is required in order to prevent mating errors with mating connectors of the same type in a group of a plurality of connectors.

Matching coding combinations on the connectors and mating connectors ensure that only correctly coded connector pairs are in each case mated with one another.

GB 832,658 discloses a system such as this in which a perforated sheet in each case surrounds the connector of the components to be connected. Two flanges which point in the mating direction and extend over the longitudinal face of the connector are fitted to this perforated sheet and have at least one tooth and at least one recess on the corresponding mating sheet, which engage in one another when the connectors are being mated. Numerous mating combinations can be created by appropriate variation of the tooth-recess combinations on different sheet pairs.

Furthermore, EP 1 995 829 B1 discloses a coding system which consists of two coding elements and in which mating can be achieved only when coding elements are not present, or coding elements are arranged correctly distributed, on both coding elements. The coding elements can in this case be inserted loosely into, pressed firmly into, or can be riveted into the coding elements.

This has the disadvantage that the coding options are highly inflexible. In the solution of GB 832,658, the entire flange must be removed for recoding and a new one produced, in order to produce a new mating combination.

The solution described in EP 1 995 829 B1 has the disadvantage that the coding elements are either not fitted fixed in the coding element, or a coding measure can no longer be varied by means of the proposed options.

The invention is based on the object of providing a system for preventing mating errors between electrical connectors, in which the various coding combinations for different connector pairs can be assembled from identical parts, and can likewise be varied again, in order to provide reliable and variable coding combinations using simple components.

BRIEF DESCRIPTION OF THE INVENTION

This object is achieved by forming the mounting frame from a front holding frame, which is first in the mating direction, and a second, rear securing frame, which is arranged immediately behind it, wherein the front holding frame has coding openings for insertion of coding elements, and wherein the rear securing frame can be connected to the front holding frame in order to secure the coding elements which can be inserted into the front holding frame.

Advantageous embodiments of the invention are specified in the dependent claims.

The invention relates to a system for preventing mating errors between electrical connectors, preferably D-sub connectors. In this case, it is particularly advantageous that no modification is required to the actual connector itself, and the coding system can also be fitted retrospectively.

For this purpose, the system consists of a mounting frame which, in order to code the connectors, is fitted to the attachment flange of the connector and to the attachment flange of the mating connector, with the plug contacts on the connectors not being concealed.

The mounting frame is formed from two frame elements, a front holding frame and a rear securing frame—with respect to the mating direction.

At least one coding element, preferably two coding elements, can be inserted each into one opening in the front holding frame, and the opening has a plurality of slots arranged in the form of a star.

The insertion of a coding element at the same time defines the coding of this coding element with respect to the mating connector.

For this purpose, a coding element is axially cylindrical, with a semicircular cross section, with an integrally formed portion in the form of a rib being provided along the semicircle. Furthermore, one of the end faces of a coding element is provided with a flat flange disk which engages over the cross section and can be inserted into a corresponding depression in the front holding frame, with the securing frame which is arranged behind the front holding frame securing the coding element in the depression.

The coding position of a coding element is in each case defined by means of the integrally formed portion which is in the form of a rib and engages in one of the slots which are in the form of a star. Overall, this arrangement allows 36 different combinations.

In order to generate further coding combinations, the shape of the coding elements can be changed. The cross-sectional shape of the coding element should in this case be chosen such that the endpoints of a semicircular arc are connected by an edge which has point symmetry with respect to the circle center point of the semicircular arc. This allows further coding elements to be formed, which can be combined with one another. Just three different coding elements, two of which can in each case be placed in six different positions in the holding frame, result in 324 different coding combinations.

The coding elements are arranged between the front holding frame and the rear securing frame, in which case the two frames can be latched or else screwed to one another, thus allowing the coding system to be attached as a block that will fit virtually any D-sub connector.

In this case, a further advantage is that the coding can first of all also be prepared independently of the connectors, and the system is then fitted to the connectors, and having a threaded bolt which engages in the already existing attachment openings in the connectors, and is screwed thereto.

Within the system, provision may be made for the coding elements to be inserted into the mounting frames either on one side or alternately on both sides of a connector combination.

BRIEF DESCRIPTION OF THE DRAWINGS

One exemplary embodiment of the invention will be explained in more detail in the following text and is illustrated in the drawing, in which.

DETAILED DESCRIPTION OF THE INVENTION

Figure 1A:
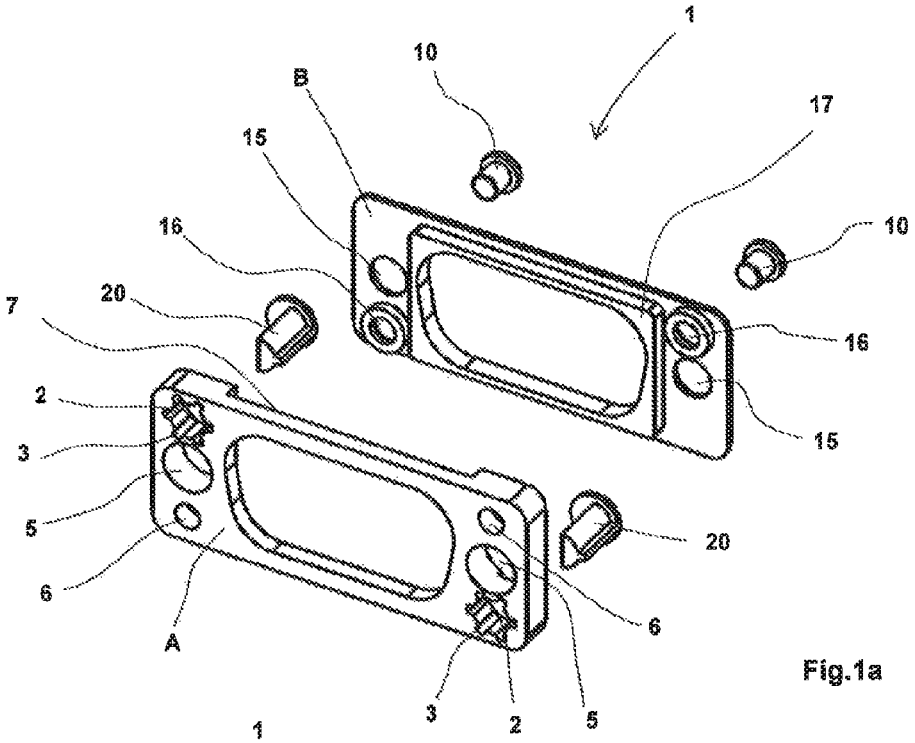
FIG. 1*a* shows a three-dimensional exploded view of a mounting frame.

FIG. 1*a* shows a three-dimensional exploded view of a mounting frame (1). The mounting frame (1) consists of a front holding frame (A) which is shown in the front area, and a rear securing frame (B), which is located in the rear area. Two coding elements (20) are arranged between the holding frame (A) and the securing frame (B).

The front holding frame (A) has two coding openings (2) at the side, into which the coding elements (20) can be inserted. Six radial slots (3) are in each case arranged over the circumference of the coding openings (2), resulting in six positions for the coding elements (20).

Furthermore, the holding frame (A) has two threaded holes (6), which are provided for attachment of the securing frame (B) by means of screws (10). Openings (5) which are located in the holding frame (A) are used to pass through connecting screws (32), which are provided on connectors (30), for screwing to mating connector (31).

The rear securing frame (B) is designed in a substantially similar manner to the front holding frame (A). The openings (15) for connecting screws (32) to be passed through are provided at the same position, with the diameter being less than in the holding frame (A), in order to allow the mounting frame (A) to be fixed to the connector (30) or mating connector (31).

Screw openings (16) which correspond to the threaded holes (6) incorporated in the front holding frame (A) are provided in the rear securing frame (B). The screws (10) can be inserted into the screw openings (16), and allow the front holding frame (A) and the rear securing frame (B) to be screwed to one another.

The securing frame (B) secures the inserted coding elements (20) in the area of the coding openings (2) on the holding frame (A) against falling out when in the assembled state.

Figure 1B:
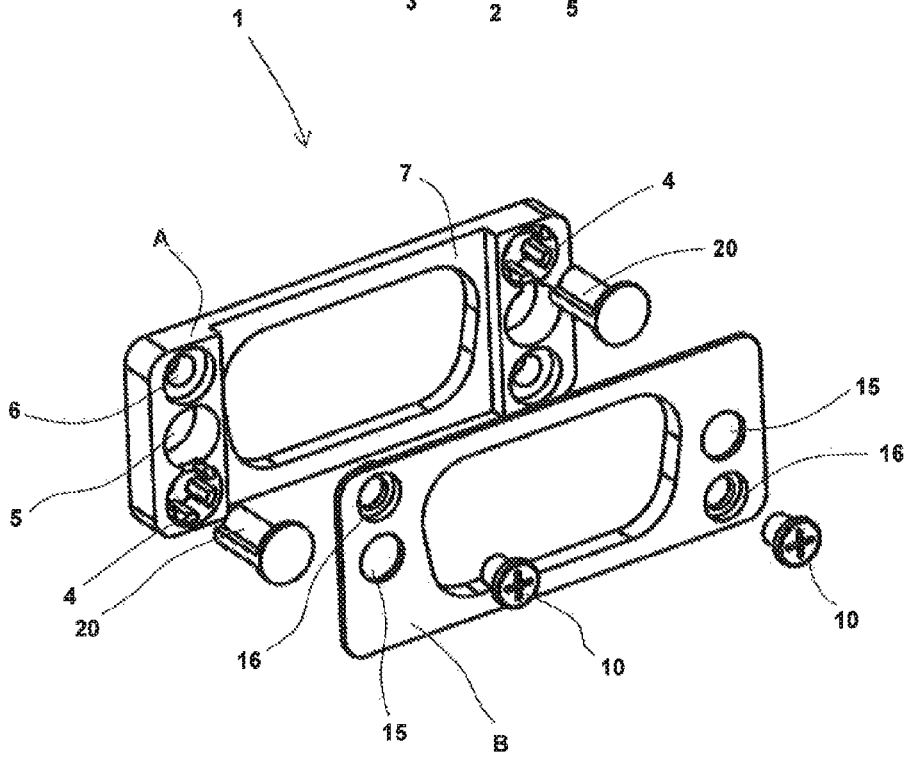
FIG. 1*b* shows a three-dimensional exploded view of the rear face of a mounting frame.

FIG. 1*b* shows a rear view of the mounting frame (1) shown in FIG. 1*a*. The coding openings (2) have a larger diameter on the rear face of the holding frame (A), thus resulting in a depression (4). The depression (4) on the coding opening (2) is provided in order to hold the coding elements (20) completely in the assembled state.

The screw openings (16) are formed on the rear face of the securing frame (B) such that the screws (10) held in them end flush with the rear face of the securing frame (B).

In addition to screws (10) for connection of the holding frame (A) to the securing frame (B), the connection between the two frames (A, B) can also or additionally be produced by latching means (7, 17) that are provided to be self-locking. According to the invention, at the rear, the holding frame (A) for this purpose has a latching cutout (7) which is in the form of a slight dovetail groove. On the front face, the securing frame (B) has an integrally formed latching portion (17), which also has a slight dovetail shape, corresponding to the latching cutout (7). When the two frames (A, B) are being connected to one another, the integrally formed latching portion (17) on the securing frame (B) latches in the latching cutout (7) in the holding frame (A), and connects them in a self-locking manner.

Figure 2A:
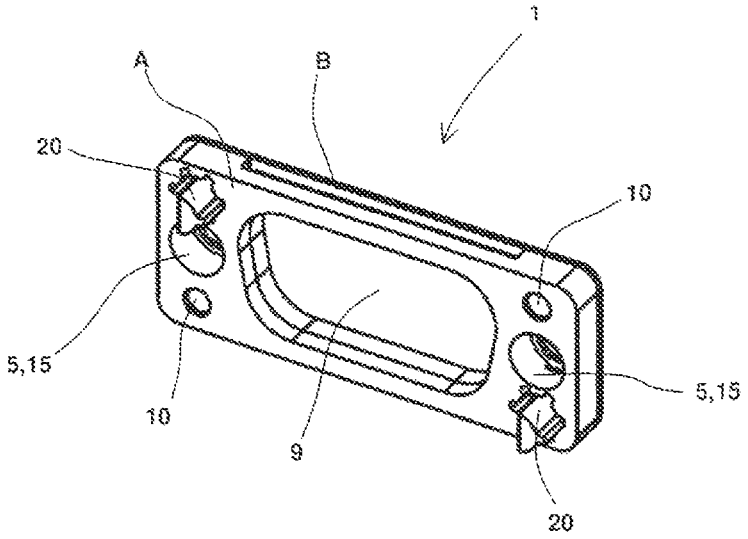
FIG. 2*a* shows a three-dimensional view of a mounting frame for connectors.

The completely assembled mounting frame (1) as shown in FIG. 1*a* and FIG. 1*b* is illustrated in a three-dimensional form in FIG. 2*a*. The figure shows the two coding elements (20) which have been inserted into the coding openings (2) and project out of the front holding frame (A). The rear securing frame (B), which is fixed to the front holding frame (A) by means of the screws (10), secures the coding elements (20) against falling out at the rear.

Together with the securing frame (B), the holding frame (A) forms an aperture (9) in the mounting frame (1). The aperture (9) is designed to hold the connector (30), as a result of which the mounting frame (1) surrounds the plug face of the connector (30). Connecting screws (32) which are provided on the connector (30) can be passed through the openings (5, 15), ensuring that the connector (30) is screwed to a mating connector (31).

Figure 2B:
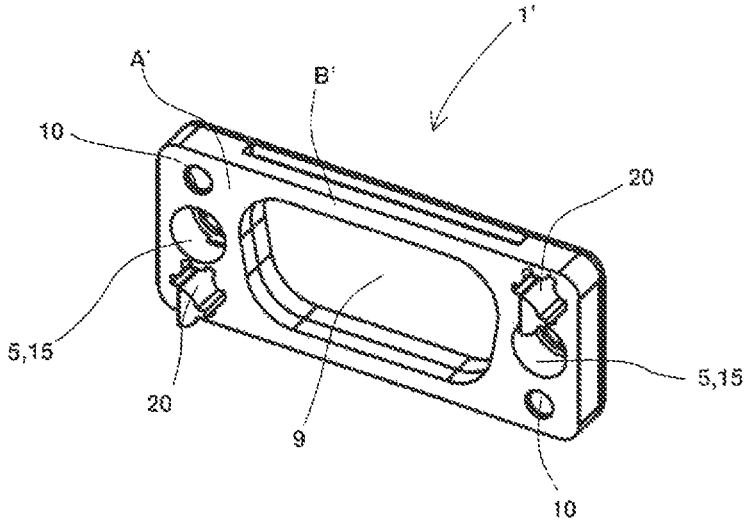
FIG. 2*b* shows a three-dimensional view of a mounting frame for mating connectors.

The mounting frame (1) illustrated in FIG. 2*a* can be used together with a mounting frame (1') as illustrated in FIG. 2*b* as a system to prevent mating errors. The illustrated mounting frame (1') is a mirror-image version of the mounting frame (1), and is intended to be fitted to a mating connector (31). When a connector (30) is being mated with a mating connector (31), the corresponding coding elements (20) and coding openings (2) are mutually opposite.

Figure 3:
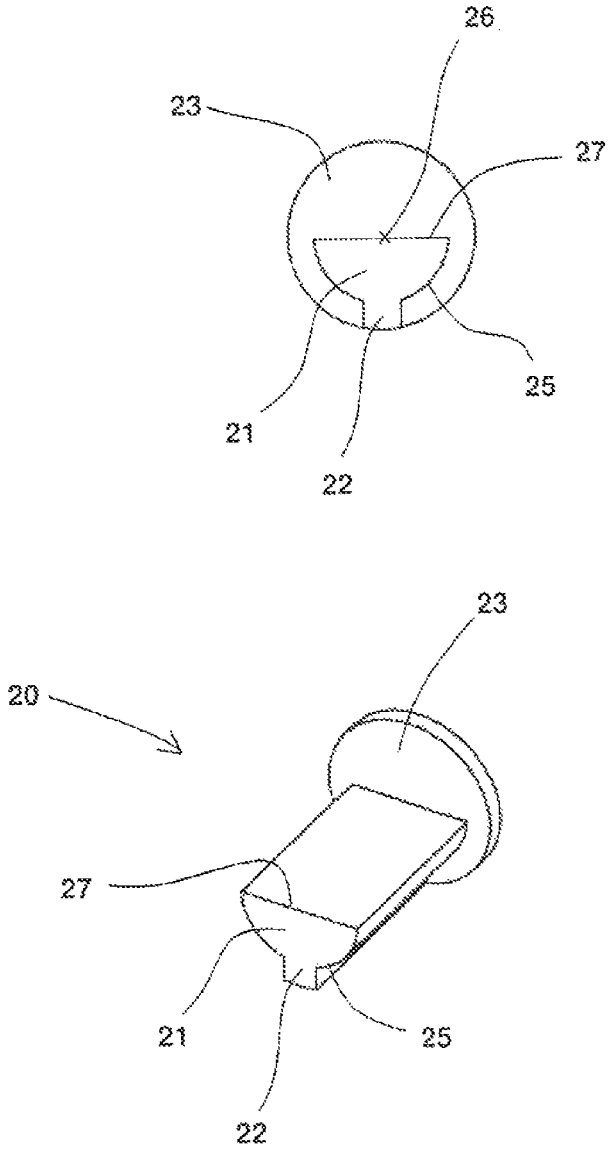
FIG. 3 shows a three-dimensional view and a front view of a coding element.

The lower area of FIG. 3 shows a three-dimensional view of a single coding element (20) and the upper area shows a front view of it.

The base body of the coding element (20) is cylindrical, with the cross section being reduced to a semicircle. The semicircular cross section (21) allows two coding elements (20) to be joined together to form a complete cylinder. At the end, the base body of the coding element (20) is provided with a flange (23), which can be inserted into the depression (4) in the holding frame (A).

An integrally formed portion (22) in the form of a rib is provided radially along the longitudinal axis on the coding element (20). The integrally formed portion (22) extends over the entire length of the coding element (20) and is intended to be inserted into one of the six slots (3) in the coding opening (2) in the holding frame (A). Depending on which of the slots (3) the integrally formed portion (22) is inserted into, this results in a different coding of the mounting frame (1). The two coding openings (2), which each have six slots (3), result in this embodiment in 36 different coding combinations.

Figure 4A:
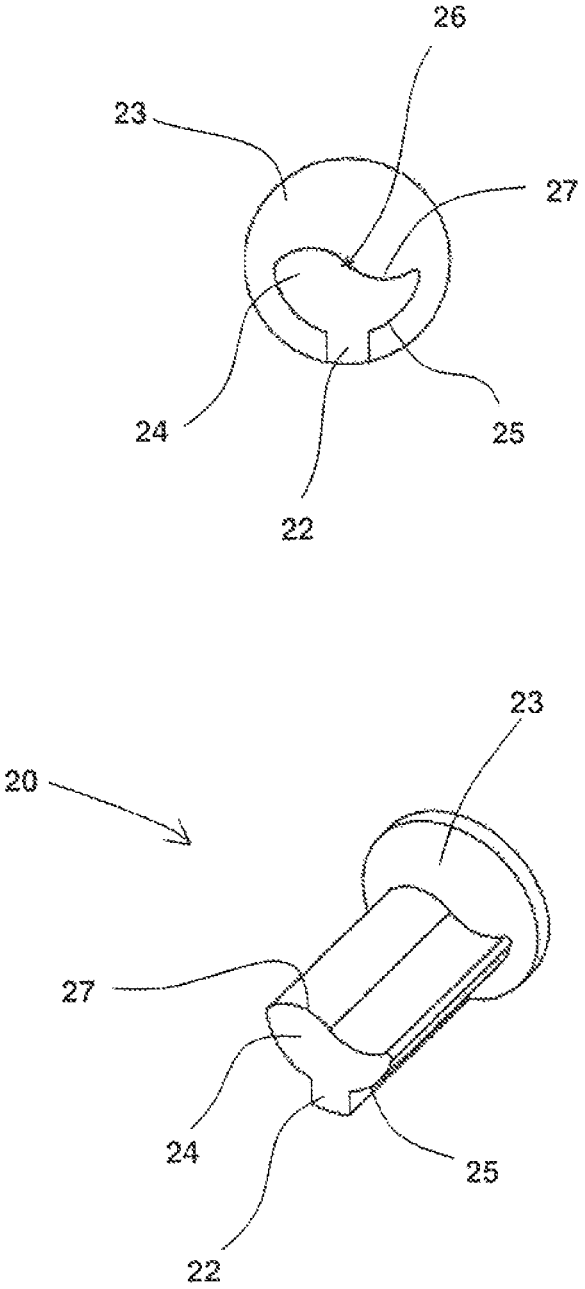
FIG. 4*a* shows a variant for coding elements.
Figure 4B:
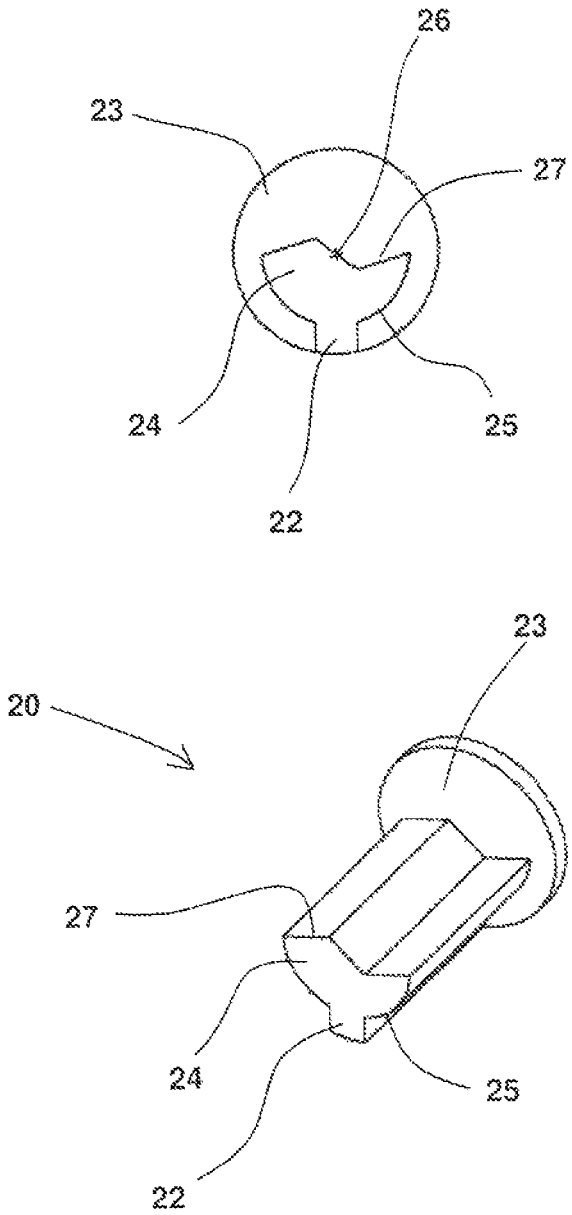
FIG. 4*b* shows a further variant for coding elements.

In order to increase the coding options, further cross sections (24) for coding elements (20) are shown in FIG. 4*a* and FIG. 4*b*. Each embodiment is illustrated as a view from the front in the upper area, and as a three-dimensional view in the lower area. The various embodiments are distinguished by the area of the cross sections (24) of the coding elements (20) in each pair being the same, and by the edge (27) of the coding elements (20) running with point-symmetry with respect to the circle center point (26). This condition allows the various embodiments to be used together, preventing mating errors.

In addition to the embodiments illustrated in FIG. 4*a* and FIG. 4*b*, it is also feasible to design coding elements (20) with different edge profiles (27), in order to increase the coding combinations.

Figure 5A:
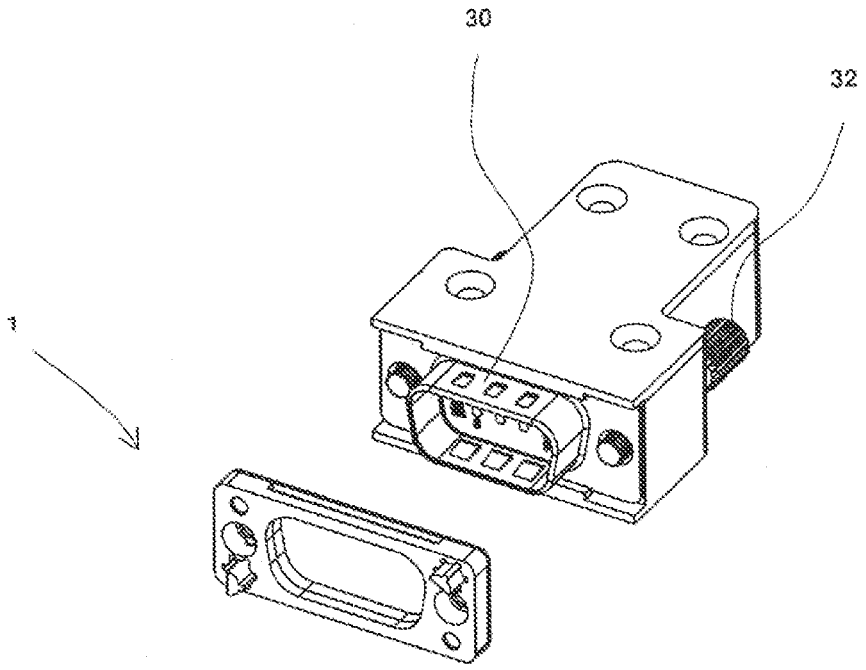
FIG. 5*a* shows a mounting frame before being fitted to a connector.
Figure 5B:
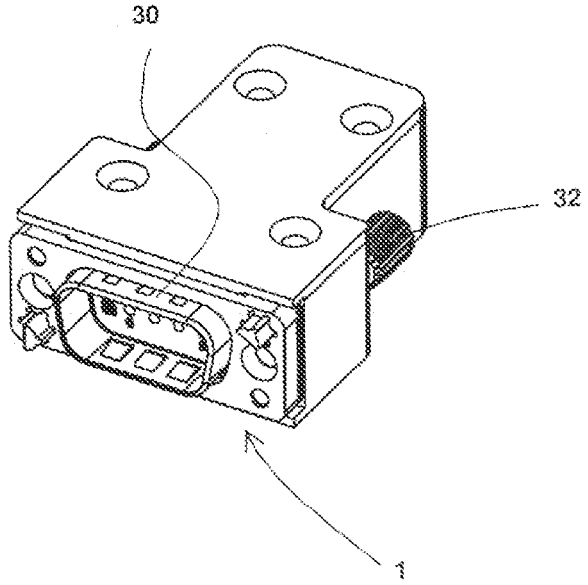
FIG. 5*b* shows a mounting frame fitted to a connector.

FIGS. 5*a* and 5*b* show three-dimensional views of amounting frame (1) before and after being fitted to a connector (30) within a surrounding housing.

Figure 6:
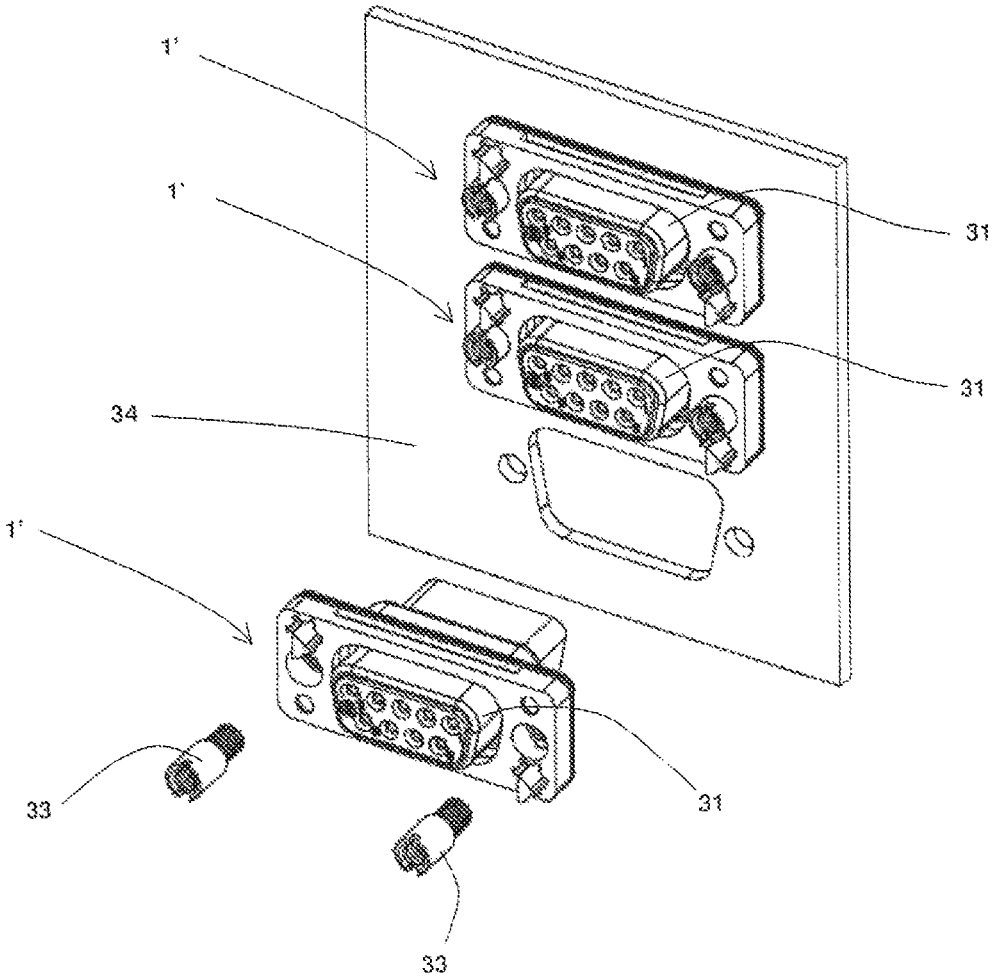
FIG. 6 shows a plurality of mounting frames fitted to mating connectors.

As an example, FIG. 6 shows three mounting frames (1') with mating connector (31). The two mounting frames (1') shown at the top have already been fitted, complete with a mating connector (31), to a housing wall (34). The lower mounting frame (1') is illustrated before being fitted by means of threaded bolts (33) into a recess in the housing wall (34).

Figure 7:
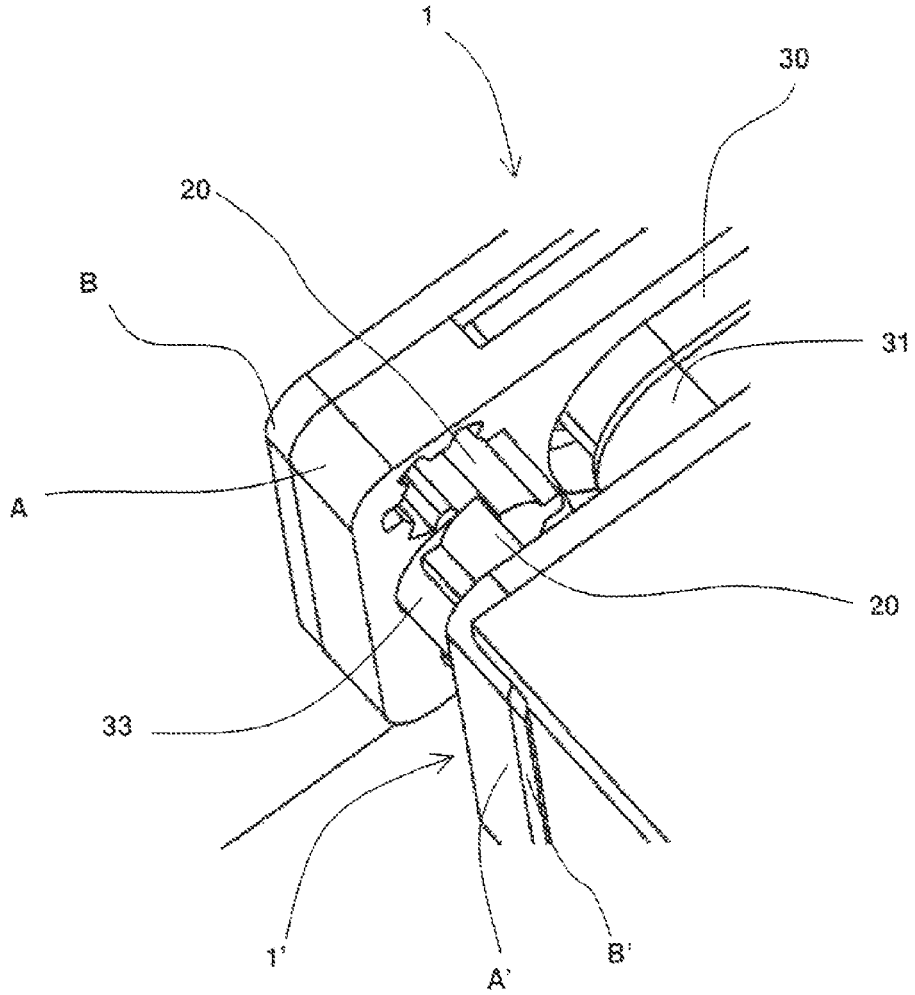
FIG. 7 shows a detail view of mounting frames with coding elements.

FIG. 7 shows an enlarged three-dimensional detailed view of a coding system consisting of two mounting frames (1, 1'). The connector (30) and the mating connector (31) to which the frames (1, 1') are fitted are not in the completely mated state. The coding element (20) on the mounting frame (1) and the coding element (20) on the mounting frame (1') slide over one another without preventing the connector (30) from being mated with the mating connector (31).

LIST OF REFERENCE SYMBOLS

System for Preventing Mating Errors Between Electrical Connectors

1, 1' Mounting frame
A, A' Holding frame
2 Coding opening
3 Slot
4 Depression
5 Opening
6 Threaded hole
7 Latching cutout
9 Aperture
10 Screw
B, B' Securing frame
15 Opening
16 Screw opening
17 Integrally formed latching portion
20 Coding element
21 Cross section (semicircular)
22 Integrally formed portion (in the form of a rib)
23 Flange
24 Cross section
25 Outer edge
26 Circle center point
27 Edge
30 Connector
31 Mating connector
32 Connecting screw
33 Threaded bolt
34 Housing wall

The invention claimed is:

1. A system for preventing mating errors between electrical connectors which can be connected to one another in pairs, comprising first and second multi-part mounting frames (1, 1'), said first mounting frame for surrounding at least a part of one connector (30), at least on the plug side, and said second mounting frame for surrounding at least a part of a mating connector (31), each of said first and second mounting frames comprising at least one coding element (20) which is arranged in the mounting frame (1, 1') and inserted through a coding opening (2) in the mounting frame (1, 1') in a radial position which can be rotatably varied about its longitudinal axis, wherein a coding element (20) of said first mounting frame surrounding a of a connector (30) interacts with a coding element (20) of said second mounting frame surrounding a part of a mating connector (31) to allow the connector (30) and mating connector (31) to be mated only when the coding elements are in a correspondingly correct position in the mounting frames (1, 1'), wherein each mounting frame (1) is formed from a front holding frame (A), which is first in the mating direction, and a second, rear securing frame (B), which is arranged immediately behind it, wherein the front holding frame (A) has coding openings (2) for insertion of coding elements (20), and wherein the rear securing frame (B) can be connected to the front holding frame (A) in order to secure the coding elements (20) which can be inserted into the front holding frame (A).

2. The system of claim 1, wherein the holding frame (A) and the securing frame (B) have corresponding latching means (7, 17) which are suitable for latching the holding frame (A) and the securing frame (B) to one another in a self-locking manner.

3. The system of claim 1 wherein the holding frame (A) and the securing frame (B) can be connected to one another by means of screws (10).

4. The system of claim 1, wherein the coding element (20) is cylindrical with a semicircular cross section (21), wherein an integrally formed portion (22) in the form of a rib is provided axially along the coding element (20), and wherein the coding element (20) has a flange (23) at one end.

5. The system of claim 4, wherein the semicircular cross section (21) of the coding element has a shape in which the end points of an outer edge (25), in the form of a semicircular arc, of the cross section (24) are connected by means of an edge (27) which is point-symmetrical at the circle center point (26).

6. The system of claim 5, wherein the outer edge (25), which is in the form of a semicircular arc, of the cross section (24) also has a different polygonal or oval shape.

7. The system of claim 4, wherein the coding openings (2) in the first, front holding frame (A) have axial slots (3) distributed over their circumference, into which coding elements (20) with the integrally formed portion (22) in the form of a rib can be inserted.

8. The system of claim 7, wherein the coding openings (2) have up to six slots (3).

* * * * *